US007429031B1

(12) United States Patent
Mitchell

(10) Patent No.: US 7,429,031 B1
(45) Date of Patent: Sep. 30, 2008

(54) GROUND SUPPORT SYSTEM

(75) Inventor: Michael Mitchell, Easton, PA (US)

(73) Assignee: Zephyr International LLC, Easton, PA (US)

( * ) Notice: Subject to any disclaimer, the term of this patent is extended or adjusted under 35 U.S.C. 154(b) by 402 days.

(21) Appl. No.: 11/311,312

(22) Filed: Dec. 20, 2005

(51) Int. Cl.
*B66D 1/26* (2006.01)

(52) U.S. Cl. ..... 254/279; 254/214; 254/216; 254/382

(58) Field of Classification Search ..... 254/214, 254/215, 216, 227, 278, 279, 382; 184/16, 184/102; 15/256.6
See application file for complete search history.

(56) References Cited

U.S. PATENT DOCUMENTS

| | | | | |
|---|---|---|---|---|
| 1,471,583 | A | | 10/1923 | Andersen |
| 2,089,287 | A | | 8/1937 | Molloy |
| 2,252,419 | A | | 8/1941 | Slaughter |
| 2,442,336 | A | | 6/1948 | Bauer |
| 2,533,782 | A | | 12/1950 | Fischer |
| 2,655,222 | A | | 10/1953 | Warwick |
| 2,789,368 | A | | 4/1957 | Wizon |
| 2,838,922 | A | | 6/1958 | Gift |
| 2,929,493 | A | | 3/1960 | Henning |
| 2,961,775 | A | | 11/1960 | Bunch |
| 3,037,720 | A | * | 6/1962 | Leithiser, Jr. ..... 242/155 BW |
| 3,057,578 | A | | 10/1962 | James |
| 3,079,100 | A | | 2/1963 | Brown et al. |
| 3,081,957 | A | | 3/1963 | Van De Bilt |
| 3,111,286 | A | | 11/1963 | Lorenz |
| 3,113,739 | A | | 12/1963 | Elder |
| 3,368,335 | A | | 2/1968 | Horvath |
| 3,371,879 | A | | 3/1968 | Hill |
| 3,379,385 | A | | 4/1968 | Osweiler |
| 3,467,360 | A | * | 9/1969 | Mizell ..... 254/338 |
| 3,717,325 | A | | 2/1973 | Peterson |
| 3,776,519 | A | | 12/1973 | Hamilton |
| 3,793,904 | A | | 2/1974 | Grable |
| 3,838,752 | A | | 10/1974 | Berkovitz |
| 3,863,861 | A | | 2/1975 | Bellasio |
| 3,879,978 | A | | 4/1975 | Harris, Jr. |
| 3,918,653 | A | * | 11/1975 | Harms et al. ..... 254/285 |
| 4,225,119 | A | * | 9/1980 | Frommherz ..... 254/294 |
| 4,236,696 | A | * | 12/1980 | Hicks et al. ..... 254/297 |
| 4,422,208 | A | * | 12/1983 | Rohrbaugh ..... 15/256.6 |
| 4,468,006 | A | | 8/1984 | Frommherz |
| 4,523,118 | A | * | 6/1985 | Cunningham ..... 310/90 |
| 4,651,974 | A | * | 3/1987 | Frommherz ..... 254/294 |
| 4,749,059 | A | | 6/1988 | Jonnes et al. |
| 5,022,493 | A | | 6/1991 | Buckelew |
| 5,390,400 | A | | 2/1995 | Jacob et al. |
| 5,422,454 | A | | 6/1995 | Kajitori |

(Continued)

*Primary Examiner*—Emmanuel M Marcelo
(74) *Attorney, Agent, or Firm*—Blank Rome LLP

(57) ABSTRACT

A ground support system for wire rope of a hoist that includes a support, and at least two tension capstans aligned on the support. Each of the tension capstans is rotatable, and each of the tension capstans has at least one annular groove engageable with the wire rope. An inspection device is mounted to the support to inspect the wire rope. A take-up member rotatably is mounted on the support and has an inner receiving area for receiving the wire rope. A drive member is coupled to one of the tension capstans and to the take-up member. The drive member rotates the one of the tension capstans and the take-up member and applies a load to the wire rope.

39 Claims, 6 Drawing Sheets

U.S. PATENT DOCUMENTS 5,582,748 A * 12/1996 Yoshie et al. ..... 219/121.64
5,653,898 A * 8/1997 Yoshie et al. ..... 219/121.63
5,806,780 A 9/1998 Schneider et al.
5,984,277 A * 11/1999 Kanzler et al. ..... 254/361
6,390,406 B1 5/2002 Wood
6,715,708 B2 4/2004 Wood

* cited by examiner

GROUND SUPPORT SYSTEM

FIELD OF THE INVENTION

The present invention relates to a ground support system for inspecting and maintaining wire rope of a hoist. More specifically, the ground support system maintains constant tension on the wire rope to facilitate inspection and prevent damage to the wire rope and the hoist.

BACKGROUND OF THE INVENTION

Helicopters are used to great advantage in Search and Rescue (SAR) operations. A hoist is used in the helicopter to lower a rescue hook, a harness, a basket or other retrieval device at the end of a wire rope or cable, allowing the rescued person to be lifted up into the helicopter. Typically, the hoist is located above a door or other ingress/egress point on the helicopter, and positioned so that the rescued person is at the same level with the door when the wire rope is completely taken up.

The wire rope of the helicopter rescue hoist is typically wrapped tightly on a drum and is extended and retracted during operations. Hoist failures often occur when the hoist is run under no load and the wire rope becomes loose on the drum and fouls the rescue hoist mechanism. That is especially true when the hoist is operated on the ground during inspections and maintenance of the hoist and wire rope. During inspection and maintenance, the wire rope is often unprotected and slack in the wire rope can result in damage to the wire rope and the rescue hoist. If the hoist wire rope loosens, significant damage to the hoist can result. Miswraps of the wire rope on the hoist drum due to loosening of the wire rope can foul the hoist in flight putting the crew and mission in jeopardy.

SUMMARY OF THE INVENTION

Accordingly, an object of the present invention is to provide a ground support system that maintains constant tension on a hoist wire rope as it extends and retracts from the hoist, that reduces premature loosening of the wire rope, and reduces fouling (i.e. loose wire rope on the hoist drum) of the hoist.

Another object of the present invention is to provide a ground support system that protects the wire rope during inspection and maintenance of the hoist, thereby preventing damage to the wire rope.

The foregoing objects are basically attained by a ground support system for wire rope of a hoist that includes a support, and at least two tension capstans aligned on the support. Each of the tension capstans is rotatable, and each of the tension capstans has at least one annular groove engageable with the wire rope. An inspection device is mounted to said support to inspect the wire rope. A take-up member is rotatably mounted on the support and has an inner receiving area for receiving the wire rope. A drive member is coupled to one of the tension capstans and to the take-up member. The drive member rotates the one of the tension capstans and the take-up member and applies a load to the wire rope.

The foregoing objects are also attained by a ground support system for a wire rope of a hoist that includes a support, means for inspecting mounted to said support for inspecting the wire rope for defects, a means for maintaining tension on the wire rope as it reels on and off the hoist disposed on the support, a take-up means disposed on the support for storing the wire rope, and a means for applying tension to the wire rope coupled to the means for maintaining tension on the wire rope and the take-up means that rotates the means for maintaining tension on the wire rope and the take-up means.

The foregoing objects are also attained by a method of maintaining a wire rope of a hoist that includes the steps of reeling the wire rope off of or onto the hoist, wrapping the wire rope around at least two tension capstans, storing the wire rope in a take-up member, rotating the tension capstans and the take-up member, and pulling the wire rope that is wrapped around the tension capstans, thereby maintaining a constant tension on the wire rope as the wire rope is reeled off or reeled onto the hoist.

Other objects, advantages and salient features of the invention will become apparent from the following detailed description, which, taken in conjunction with the annexed drawings, discloses a preferred embodiment of the present invention.

BRIEF DESCRIPTION OF THE PREFERRED EMBODIMENT

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Referring to FIGS. 1-8, the present invention relates to a ground support system 100 for facilitating proper inspection and maintenance of wire rope or cable 102 used with hoists, such as helicopter rescue hoists, and particularly for maintaining sufficient tension on the wire rope 102 as it is reeled off and onto the hoist. By maintaining a constant tension damage to the wire rope is minimized and inspection of the wire rope for defects is facilitated. The system 100 tensions the wire rope without having to fly the helicopter.

Figure 1:
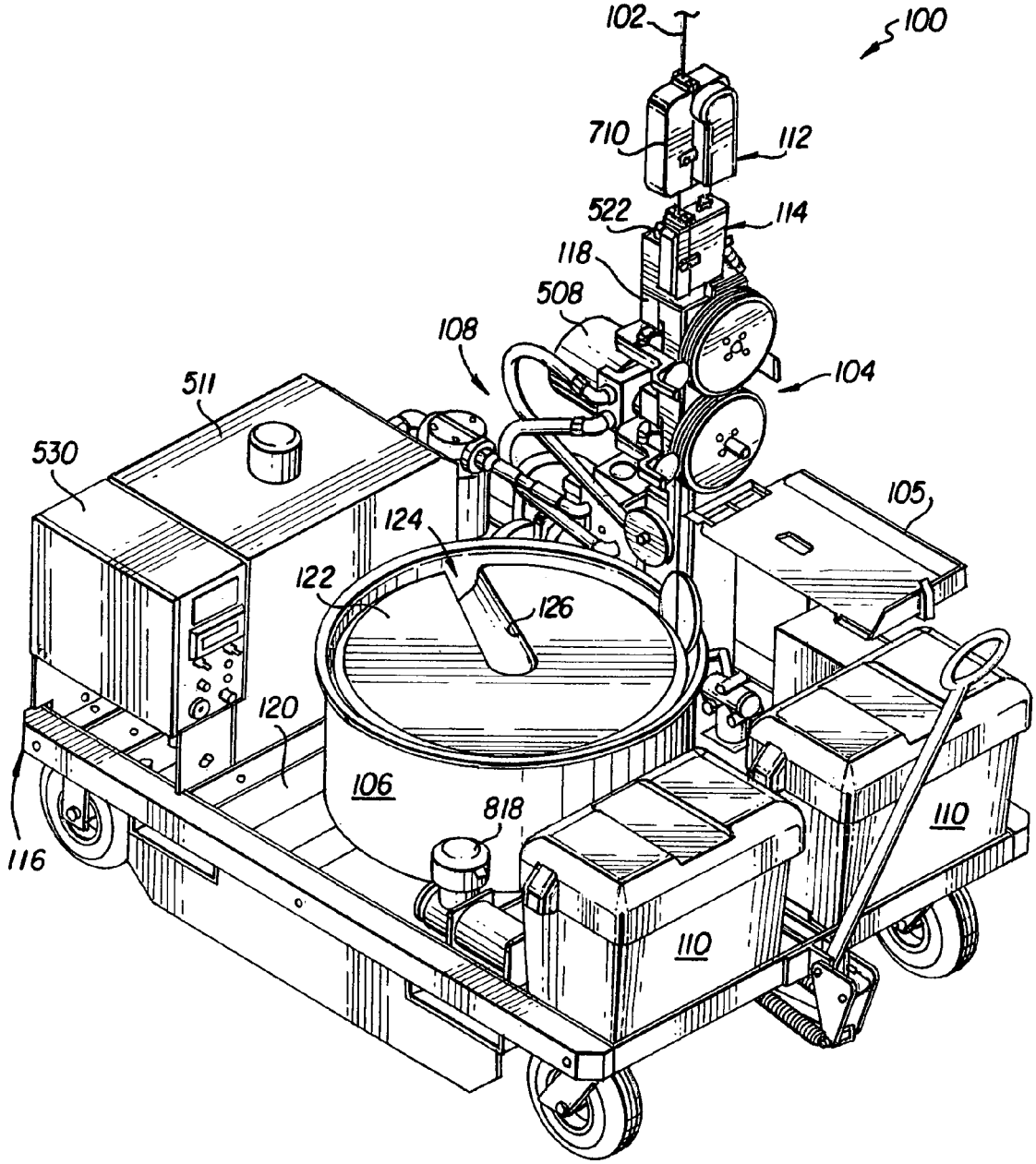
FIG. 1 is perspective view of the ground support system in accordance with the present invention.

As seen in FIG. 1, the system 100 generally includes rotating capstans 104 for maintaining tension on the wire rope 102, a take-up member 106 for collecting and storing the wire rope 102, and a drive member 108 that applies tension to the wire rope 102, and rotates the dual capstans 104 and tub 106 at substantially the same velocities. The drive member 108 together with the capstans 104 pulls on the wire rope 102 as it is being reeled off and on the hoist, thereby maintaining tension on the wire rope 102 at all times. A power source 110 supplies power to the drive member 108. The system 100 employs an inspection device 112 that interfaces with a computer to determine the integrity of the wire rope 102. A cleaning device 114 is also provided in the system 100 to clean, dry, and/or lubricate the wire rope 102.

The system 100 allows all inspections and maintenance operations to be performed in a minimum amount of time; maintains tension on the wire rope 102 as it extends from the hoist and applies a load over the length of the wire rope 102 as it retracts, while protecting the wire rope 102 in the take-up member 106 during maintenance; is capable of cleaning and drying the wire rope 102 particularly if the wire rope 102 was exposed to salt water; and can lubricate the wire rope 102 if necessary.

As seen in FIG. 1, the system 100 is supported by a mobile frame 116. A vertical support member 118 of the frame 116 supports the capstans 104, the inspection device 112 and the cleaning device 114. The base 120 of the frame 116 supports the take-up member 106, the drive member 108, and the power source 110.

Figure 2:
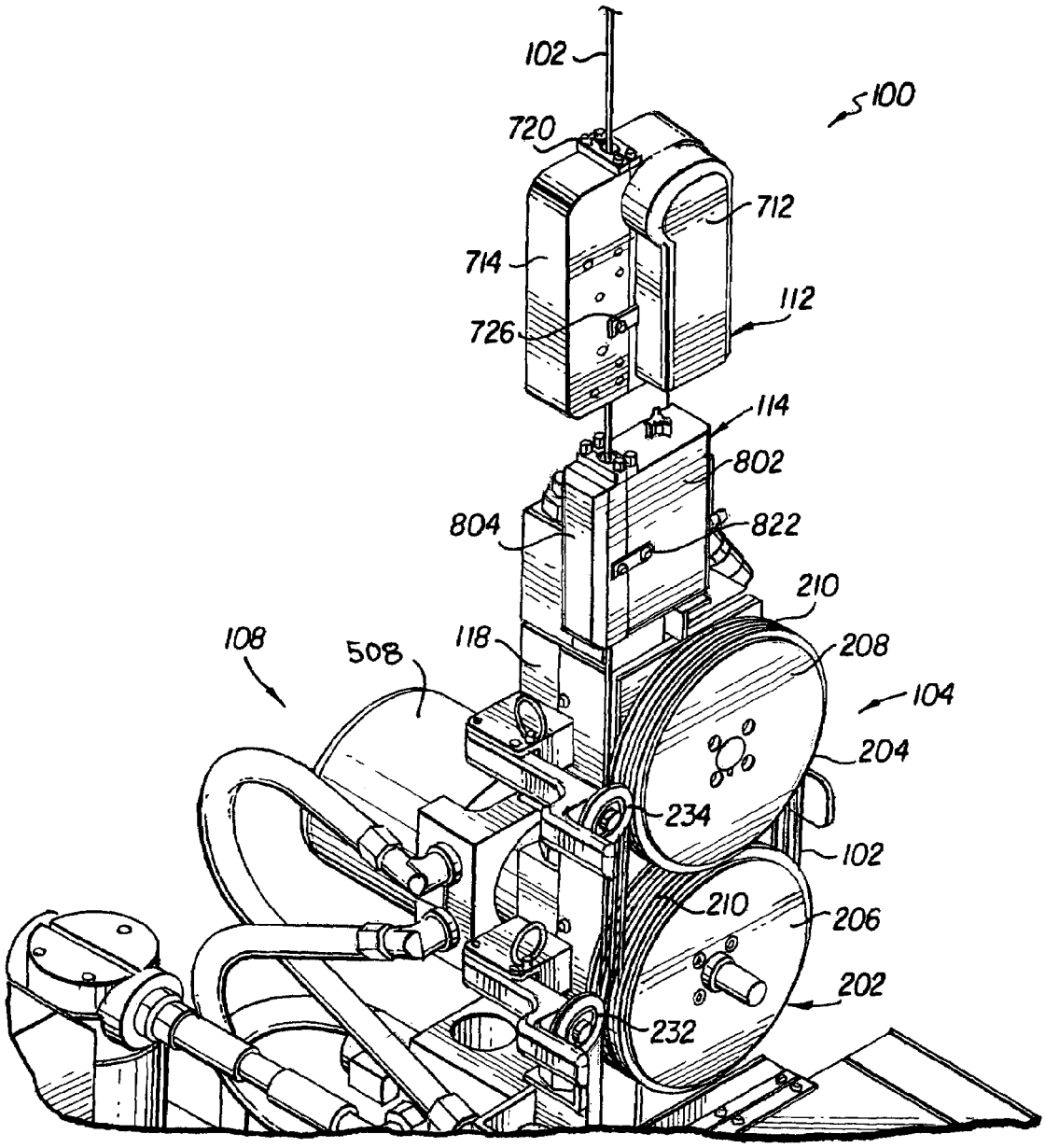
FIG. 2 is an enlarged view of the ground support system illustrated in FIG. 1, showing dual capstans, an inspection device, and a cleaning device of the ground support system.

The capstans 104 are vertically aligned on the vertical support member 118 and preferably include two capstans, that is a lower capstan 202 and an upper capstan 204, as best seen in FIG. 2. A transparent shield 105 (FIG. 1) covers the lower and upper capstans 202 and 204. Each capstan 202 and 204 includes a molded sheave 206 and 208, respectively, and each sheave 206 and 208 includes a plurality of annular grooves 210 for receiving the wire rope. Each groove 210 is preferably shaped to tightly receive the wire rope 102, thereby gripping the wire rope 102 without damaging the wire rope 102. Specifically, each groove 210 can have an inner diameter that is slightly smaller than the outer diameter of the wire rope 102, so that the wire rope 102 is compressed when received in the grooves 110. Three annular grooves 110 are preferably employed with the capstans 104 allowing the wire rope 102 to be wrapped three times around the lower and upper capstans 202 and 204. Although three grooves 110 are preferred so that the wire rope 102 can be wrapped three times around capstans 102, fewer than three grooves 110 can be used if less tension is required, or more than three grooves can be used if more tension is required.

A first center shaft 212 (FIG. 3) extends through the center of sheave 206 and through the support member 118, thereby rotatably coupling the lower capstan 202 to the support member 118. Similarly, a second center shaft 214 (FIG. 3) extends through the sheave 208 and the support member 118, thereby rotatably coupling the upper capstan 204 to the support member 118. A drive chain 302 (FIGS. 3 and 4) is coupled to the shafts 212 and 214 allowing the lower and upper capstans 202 and 204 to rotate together via drive member 108.

The capstans 104 prevent the wire rope 102 from loosening by applying tension based on the capstan principle and the design of the grooves 210 which grip the wire rope 102. According to the capstan principle, the tension ($T_2$) of the wire rope after being wrapped around a capstan or drum is an exponential function of the total angular wrap ($\beta$) around the capstan and the coefficient of friction ($\mu$) between the wire rope and the capstan material multiplied by the initial tension $T_1$, that is $T_2=T_1e^{\mu\beta}$. The coefficient of friction is affected by lubrication of the interface between the wire rope 102 and the material of the capstans 104. System 100 can operate with wire ropes that are lubricated and non-lubricated. The material of the capstans 104 preferably maintains high friction between the wire rope 102 and the respective sheaves 206 and 208. The capstan material can be polyurethane which provides high friction even if the wire rope 102 is lubricated. For example, with a minimum coefficient of friction of 0.34, the capstans 104 together with the drive member 108 can create over 600 lbs of tension or pulling force $T_2$ with a load of just one pound on the low tension side $T_1$. Higher loads can be applied to the wire rope if required by wrapping the wire rope 102 more than three times around the capstans 104, thereby increasing the angle of wrap and thus increasing tension $T_2$.

Because the grooves 210 apply a small amount of compression on the wire rope 102, an additional frictional force is added that increases $T_2$. Conventional rescue hoist wire ropes have a nominal outer diameter and a minimum allowable diameter before replacement is mandated. The inner diameter of the grooves 210 is based on the minimum allowable diameter. The compression applied by the grooves 210 will be maximum for a new wire rope and minimum for a wire rope at the end of its service life. The size of the capstans 104 and the grooves 210 can be changed to fit any wire rope diameter.

As seen in FIG. 2, the wire rope 102 is held tightly against the lower and upper capstans 202 and 204 by lower and upper pressure rollers 232 and 234. Each roller 232 and 234 is disposed on the support member 118 adjacent the lower and upper capstans 202 and 204, respectively, and is biased toward the lower and upper capstans 202 and 204, respectively, thereby applying pressure to the wire rope 102 when received in the grooves 210. Each roller 232 and 234 can pivot outwardly when installing the wire rope 102 on the lower and upper capstans 202 and 204.

The dual capstans 104 feed the wire rope 102 into the take-up member 106 which is preferably a rotating tub. The rotating tub 106 is rotatably coupled to the base 120 of the frame 116 with an infinitely adjustable platen assembly 304 (FIGS. 3 and 4) therebetween. The rotating tub 106 includes a spooler 122 (FIG. 1) that rests inside of the tub 106. A wire rope receiving area 124 is defined between the spooler 122 and the inner wall of the tub 106. A cut-out 126 is provided in the spooler 122 for receiving the end of the wire rope 102. The wire rope 102 wraps around the spooler 122 in the receiving area 124, to safely store the wire rope 102 during inspection and maintenance. The tub 106 rotates at substantially the same tangential velocity as the capstans 104, thereby avoiding slack in the wire rope 102.

Figure 4:
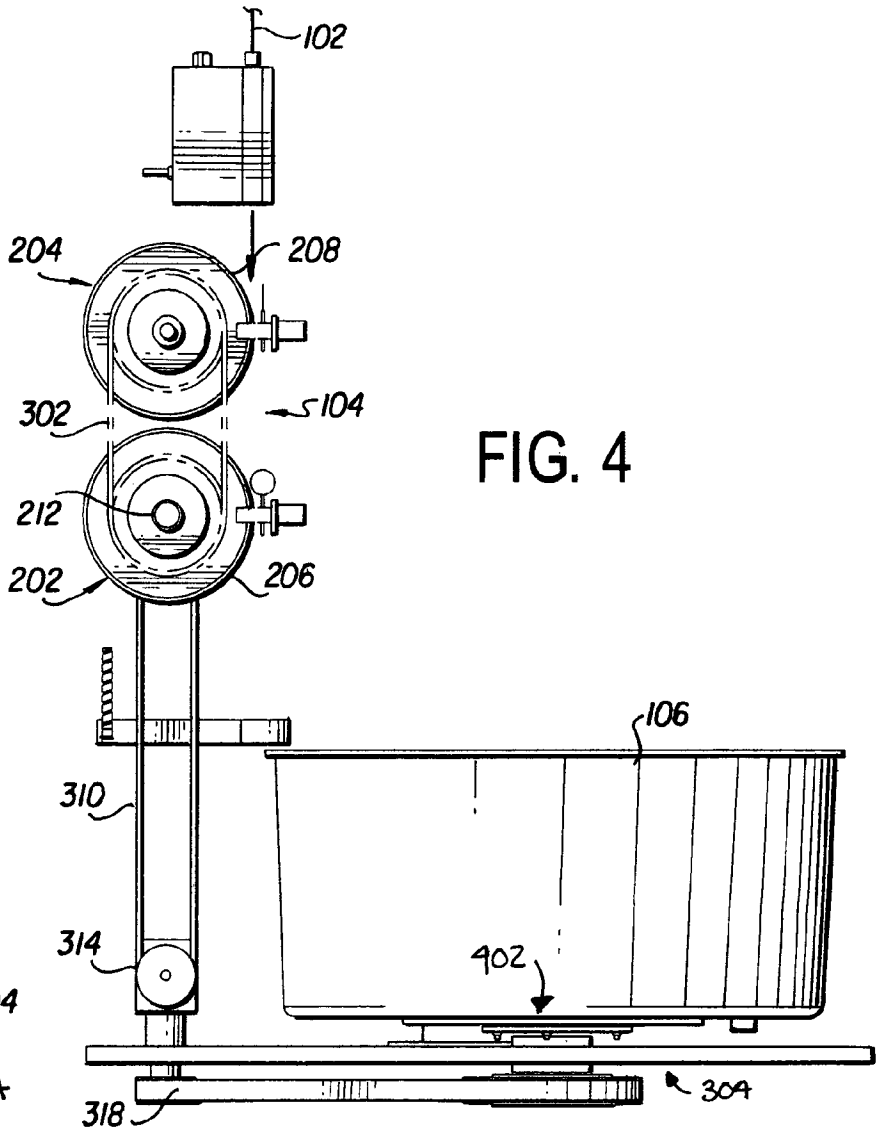
FIG. 4 is a rear elevational view of the ground support system illustrated in FIG. 3.
Figure 3:
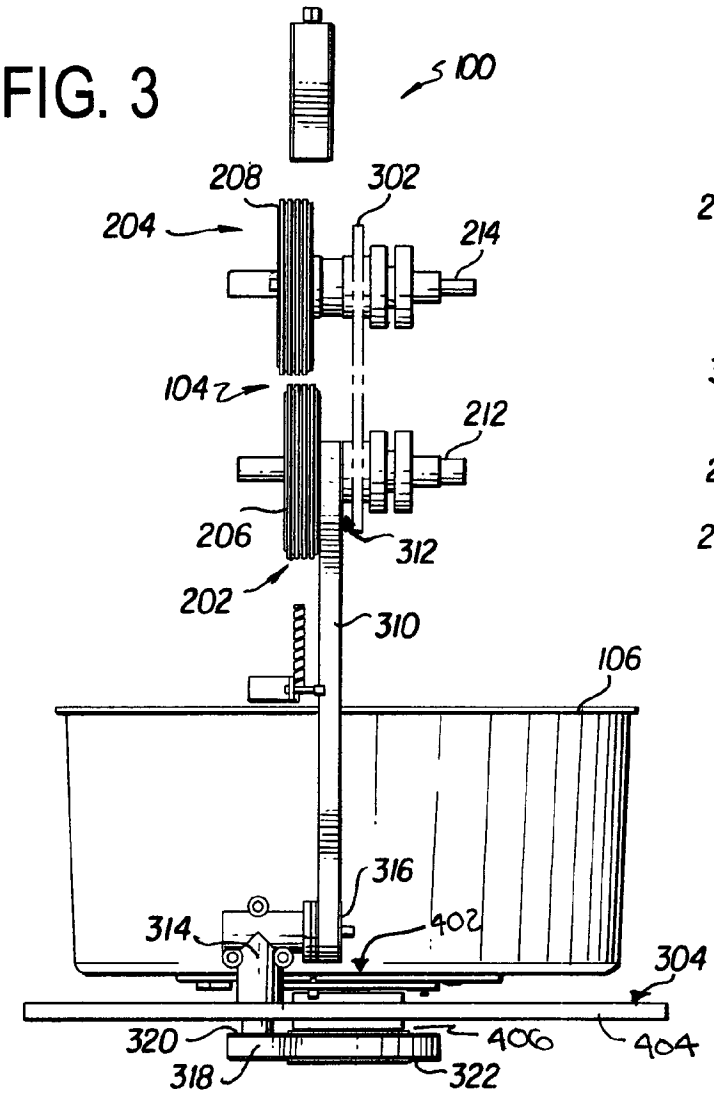
FIG. 3 is a side elevational view of the ground support system illustrated in FIG. 1, showing the dual capstans and a storage tub without a support of the system.
Figure 5:
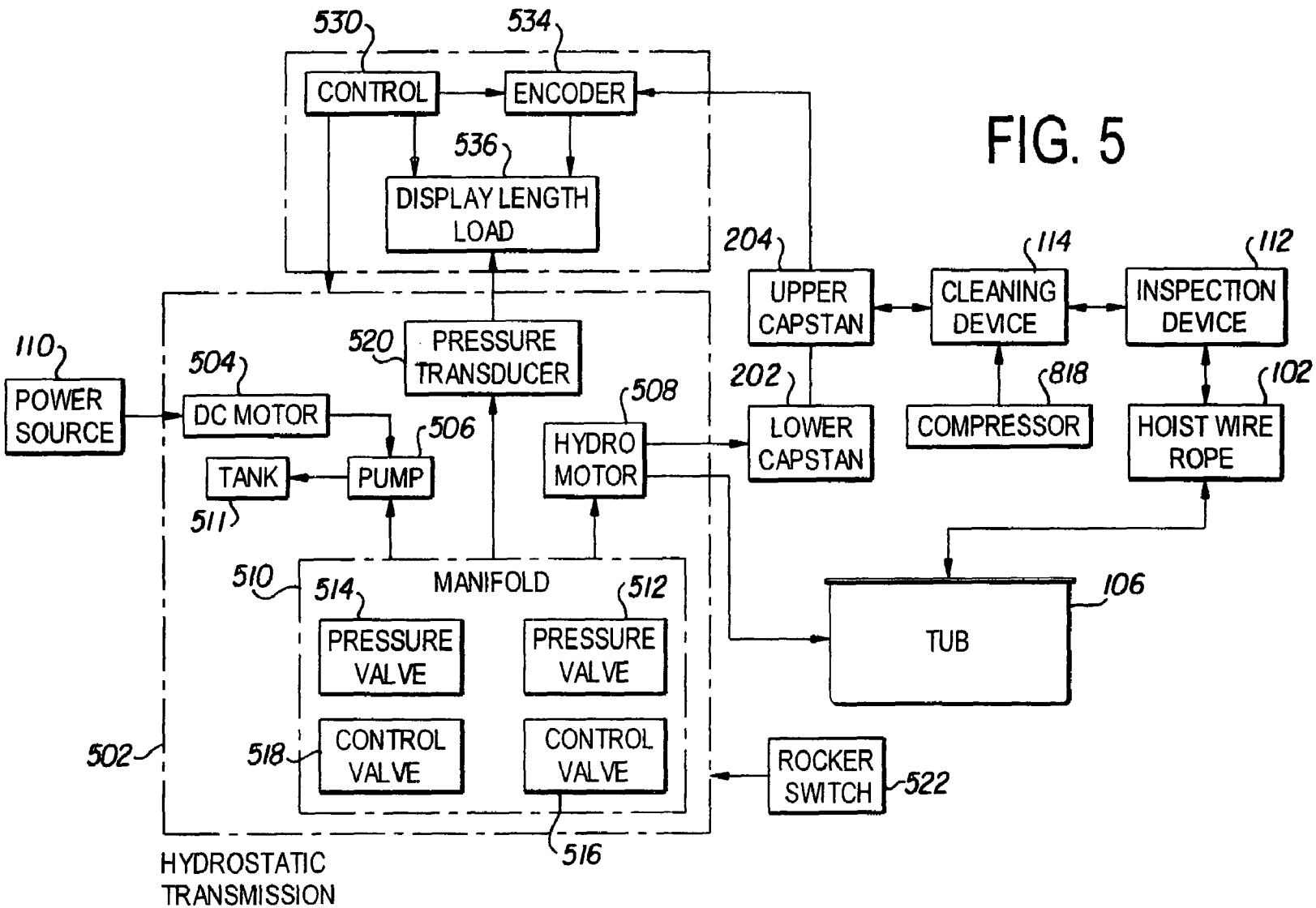
FIG. 5 is a block diagram of the ground support system illustrated in FIG. 1.

As seen in FIGS. 3 and 4, the capstans 104 and the tub 106 are connected by a series of belts and pulleys. A vertical timing belt 310 is coupled at one end to the shaft 212 of the lower capstan 202 by a first pulley (P1) 312 and coupled at the other end to an intermediate right angle drive 314 by a second pulley (P2) 316. A drum drive belt 318 is coupled at one end to the right angle drive 314 by a third pulley (P3) 320 and coupled to at the other end to a fourth pulley (P4) 322 at the bottom of the tub 106. The first, second, third and fourth pulleys 312, 316, 320 and 322 are timing pulleys that provide a positive timing ratio from one to the other. The tangential velocity of the wire rope 102 as it leaves the capstans 104 is matched to the tangential velocity of the wire rope 102 as it is collected in the receiving area 124 of the tub 106 by a ratio of P1/P2×P3/P4. Because the tangential velocity in the tub 106 will vary as the wire rope 102 piles up, adjustment is provided by a platen assembly 304 onto which the tub 106 is mounted to prevent twisting of the wire rope 102 and eliminating load on the wire rope 102 when received in the tub 106. The platen assembly 304 incorporates a slip clutch 402 (FIGS. 3 and 4) that with adjustment screws provides the adjustment. Upper and lower discs 404 and 406 of the platen assembly 304 are attached by the adjustment screws that provide a controlled squeeze on a friction disc therebetween. The upper and lower discs 404 and 406 and the friction disc are supported on an axle of the assembly 304 which is coupled to the fourth pulley 322. The amount of torque the platen 304 will slip at is controlled by the adjustment of the adjustment screws and a spring force provided by spring washers that cooperate with the adjustment screws. Storage tub 106 is attached to the platen assembly 304 by the attachment screws.

Figure 6:
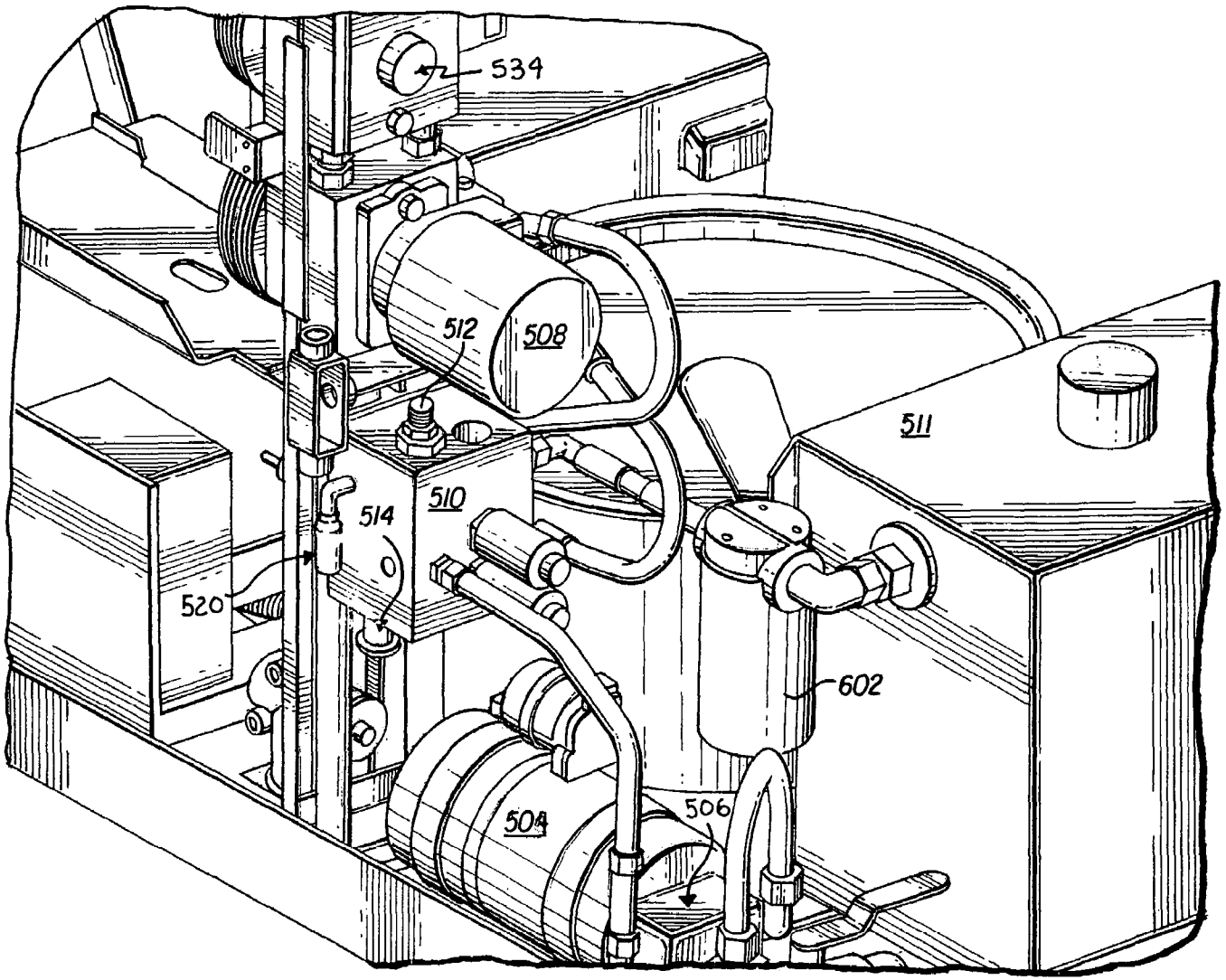
FIG. 6 is perspective view of a drive of the ground support system illustrated in FIG. 1.

The drive member 108 is coupled to both the capstans 104 and the tub 106 and rotates both at substantially the same velocity. The drive member 108 is preferably a hydrostatic transmission 502 (FIG. 5); however, other conventional drive mechanisms can be used, such as an electric regenerative drive. The hydrostatic transmission 502 includes a circuit of an electric motor 504 that drives a fixed displacement pump 506 and a fixed displacement hydraulic motor 508 and a manifold 510. The hydrostatic transmission 502 also includes a hydraulic tank 511 that holds the hydraulic fluid for the circuit. When the fluid returns to the tank 511, it passes through a filter 602 (FIG. 6), which can include an indicator to warn when the filter needs to be replaced. As seen in FIGS. 1 and 6, the hydraulic motor 508 is coupled to the shaft 212 of the lower capstan 202, thereby driving both capstans 202 and 204 via drive chain 302. The manifold 510 of the hydrostatic transmission 502 includes first and second pressure relief valves 512 and 514 (FIGS. 5 and 6) for adjusting the load applied to the wire rope 102 when reeling the wire rope off of the hoist in the extending mode and onto the hoist in the retracting mode, respectively. The pressure relief valves 512 and 514 limit the pressure in the circuit by regulating flow. The manifold 510 also includes first and second direction control valves 516 and 518 that are energized when the system operates in the extending mode. A pressure transducer 520 of the hydrostatic transmission measures the pressure in the manifold 510. A rocker switch 522 (FIGS. 1 and 5) of the hydrostatic transmission 520 allows the operator to switch the system between extending and retracting modes, and off.

In the extending mode, the electric motor 504 drives the pump 506 to supply fluid to the hydraulic motor 508 at a pressure, that is resistance to flow, controlled by the first pressure relief valve 512. The setting of the first pressure relief valve 512 controls the maximum pressure in the circuit when the system is in the extending mode. As the pressure increases in the circuit to the set value, the first pressure relief valve 512 begins to dump fluid back to the tank 511, thus setting the extend pressure. The first pressure relief valve 512 is adjustable by manually turning a knob of the valve 512. The output torque of the hydraulic motor 508 is a function of the pressure in the circuit set by the first pressure relief valve 512. The pressure is generated by the flow of the hydraulic pump 506 being driven by the electric motor 504. The tension or load applied to the wire rope 102 is related to the torque of the motor 508 divided by the pitch radius of the capstan sheaves 206 and 208 and the displacement of the motor 508. Thus, the hydraulic motor 508 pulls against the wire rope 102 at a tension or load preset by valve 512. The speed of the motor 508 is controlled by the hoist. The motor 508 will continue to pull until the maximum flow of the pump 506 is reached. The system is sized such that the maximum flow of the pump 506 is greater than the maximum speed of the hoist by a large margin.

In the retracting mode, the directional control valves 516 and 518 are de-energized and a closed loop circuit is created between the motor 508 and the second pressure relief valve 514. The torque the motor 508 creates is a function of the second pressure relief valve 514 setting. Excess fluid from the pump 506 flows back into the tank via second control valve 518. The reversed flow is blocked by the second pressure relief valve 514 which acts as a check valve. As the pressure increases in the circuit to the retract pressure setting, the second pressure relief valve begins to dump fluid to the tank 511. The hydraulic pump 506 only supplies make up fluid into the circuit to prevent cavitation. As the hoist starts to retract the wire rope 102, the hoist pulls on the capstans 104. The torque of the capstans 104 is transferred to the motor 508, which acts as a pump. The pumping action of the motor 508 increases the pressure in the circuit as a result of the flow restriction created by the second pressure relief valve 514. The pressure is created by the rotation of the motor 508 acting as a pump. The maximum pressure in the circuit is controlled by the second pressure relief valve 514 and the maximum speed of the motor 508 is controlled by the hoist. Thus, the motor 508 resists the pull of the hoist, thereby applying tension to the wire rope 102 as it is retracted onto the hoist.

A control 530 (FIGS. 1 and 5) of the system 100 collects data from the capstans 104 and the hydrostatic transmission 108 and displays the data on a display 536 in a readable form to the operator. The pressure of the hydrostatic transmission 108 measured by the pressure transducer 520, which is scaled by the control 530 to indicate the load or tension on the wire rope 102 in pounds or kilograms on the display 536. Two pressure transducers can be used instead of a single transducer by measuring the difference between the transducers to determine the load which is scaled based on the displacement of the motor 508. An alternative way of measuring the actual tension in the wire rope 102, instead of transducer 520, is to use load cells between the wheels of the mobile frame 116. The cells can be compression type load cells that are connected together in a circuit by a summing box such that the total load on the load cells can be shown on display 536. The actual weight of the system can be measured, and the output calibrated and tared (i.e. set to zero). As the tension in the wire rope 102 changes from zero, the display 536 will show the tared load (decrease in compressive load equally increase in tensile load).

An encoder 534 of the control 530 is mounted to the shaft 214 of the upper capstan 204 and provides a count that is scaled and displayed as the length of the wire rope 102 the is in the tub 106. That count is used to indicate when the wire rope 102 is approaching its end, and can be coupled to an alarm that signals when the operator has gone too far. The control 530 can include a signal conditioner and an analog to digital converter that cooperate with inspection device 112.

Figure 7:
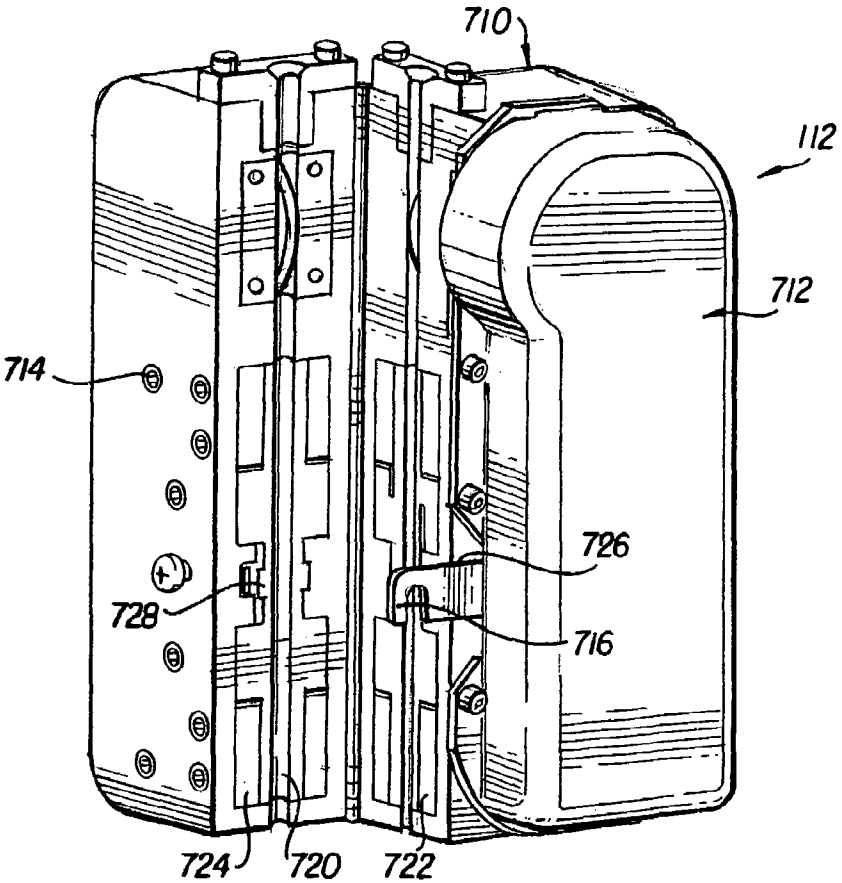
FIG. 7 is a perspective view of an inspection device of the ground support system illustrated in FIG. 1.

The structural integrity of the wire rope 102 is measured using inspection device 112. As seen in FIG. 2, the inspection device is preferably located before cleaning device 114, that is between the hoist and the cleaning device 114. A computer (not shown) interfaces with the inspection device 112 to measure and record defects in the wire rope 102. As seen in FIG. 7, the inspective device 112 is preferably a magnetic inspection device that includes a head 710 with first and second halves 712 and 714 that are pivotally connected to one another. A latch 716 secures the pivoting halves 712 and 714 in a closed position. Between the first and second halves 712 and 714 is a bore 720 that receives the wire rope 102. Disposed in each half 712 and 714 are at least first and second pairs of magnets 722 and 724, preferably strong permanent magnets, and first and second pairs of sensors 726 and 728, such as Hall Effects sensors.

In operation, the magnets 722 and 724 create a magnetic flux circuit and the sensors 726 and 728 detect variations in the magnetic flux circuit resulting from changes in the magnetic properties of the wire rope 102 as it travels through the bore 720 of the head 710, as is well known in the art. The inspection device 112 can determine the exact location of a defect in the wire rope 102, which can be confirmed by visual inspection. Although use of a magnetic inspection device is preferred, any known type of inspection mechanism can be used, such as laser micrometer, CCD (charge couple device) camera, boroscope, or magnifying glass. Alternatively, the inspection device 112 can be eliminated, so that the operator relies on visual inspection of the wire rope 102 to determine whether any defects exist.

Figure 8:
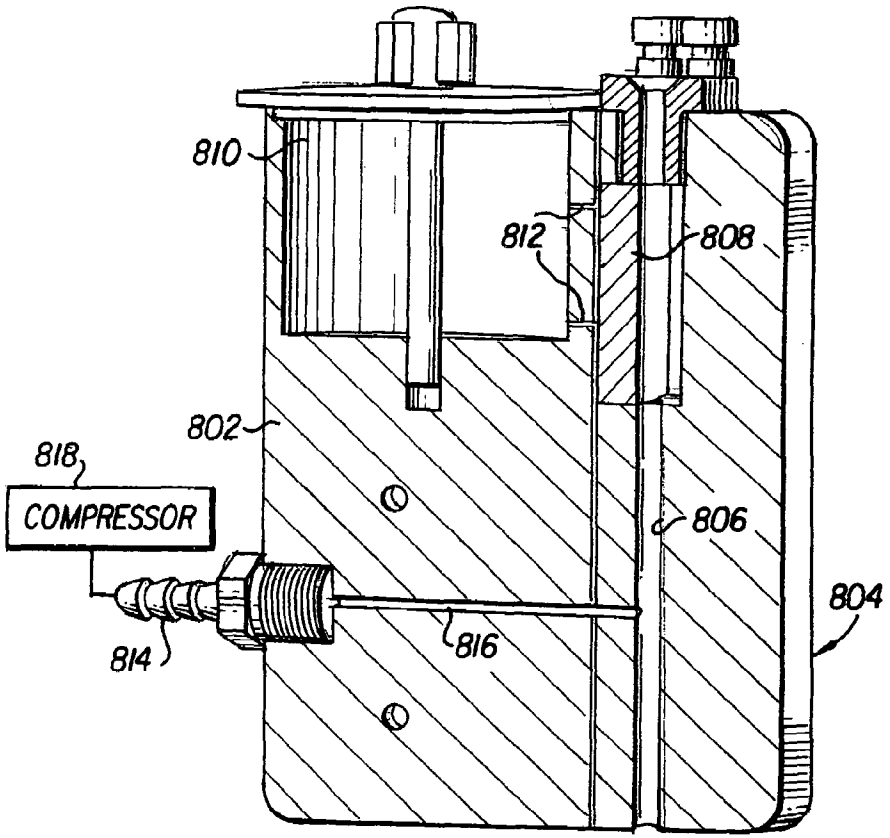
FIG. 8 is a perspective view of a cleaning device of the ground support system illustrated in FIG. 1.

As seen in FIG. 8, the cleaning device 114 of the system 100 can clean, dry, and/or lubricate the wire rope 102. The cleaning device 114 includes a main body 802 and a pivotable door 804, as seen in FIGS. 2 and 8. The wire rope 102 extends through a longitudinal bore 806 defined between the main body 802 and the door 804. Cleaning pads 808 are provided in the bore 806. The pads 808 can be secured by placing them into dovetail slots formed into the body 802 and the door 804 and are retained by retainers that act as wire guides. To replace the pads 808, the door 804 is pivoted open, thereby exposing the bore 806 and the pads 808. The body 802 includes an oil reservoir 810 in fluid communication with oil transfer holes 812 that terminate at the pads 808. The main body 802 includes an air inlet 814 in fluid communication with an air path 816 that terminated in the bore 806. An air compressor 818 (FIGS. 1 and 8) connects to the air inlet 814 to dry the wire rope 102. The bore 806 can be enlarged to allow more compressed air to reach the wire rope 102.

If the wire rope 102 has been exposed to salt water, the tub 106 can be filled with fresh water to rinse off the saline residuals. As the wire rope 102 is retracted, the compressor 818 supplies air to the cleaning device 114 which then dries the wire rope 102 before it passes though the pads 808. If the wire rope 102 requires lubrication, the reservoir 810 is filled with oil and the pads 808 become soaked with the oil. The pads 808 then transfer the oil to the wire rope as it passes through the cleaning device 114.

The general operation of the system 100 includes initially reeling the wire rope 102 off of the hoist, wrapping the wire rope 102 around the dual capstans 202 and 204, and positioning the end of the wire rope 102 in the rotating tub 106. The spooler 122 of the tub 106 holds the end of the wire rope 102 and establishes the starting position of the wire rope 102 to achieve an even storage of the wire rope 102 in the tub 106. The wire rope 102 is preferably wrapped three times around each capstan sheave 206 and 208 so that the wire rope 102 is secured in the grooves 210 of each sheave 206 and 208. Pressure rollers 232 and 234 hold the wire rope 102 firmly in the grooves 210. Each pressure roller 232 and 234 can be held open, such as by hitch pins, when installing and removing the wire rope 102 from the capstans 104.

The system 100 is operated by the rocker switch 522 which can be moved down for the extending mode, up for the retracting mode, and off. When the operator reels the wire rope 102 off of the hoist, the hydraulic pump 506 and hydraulic motor 508 of the hydrostatic transmission 502 provide a steady load on the wire rope 102. The motor 508 rotates the lower and upper capstans 202 and 204 in a counterclockwise direction (with respect to the front of the system 100) via the shaft 212 of the lower capstan 202 and the drive chain 302 connecting the lower and upper capstans 202 and 204. The motor 508 substantially simultaneously rotates the rotating tub 106 in a clockwise direction (with respect to the front of the system 100) via the timing belt 310, drive belt 318, right angle drive 314 and pulleys 312, 316, 320 and 322 at substantially the same pitch velocity as the capstans 202 and 204. The capstans 104 and the rotating tub 106 can rotate in the same direction, i.e. both clockwise or counterclockwise, if the rotating tub 106 is aligned with the capstans 104 or located on a side of the capstans 104 that is the opposite side to the location of tub 106 as shown in FIG. 1. The steady load combined with the wire rope 102 being wrapped around the dual capstans 104 produces a constant tension on the wire rope 102, thereby preventing damage to the wire rope 102 and the hoist. A load indicator of the control 530 displays the load being applied to the wire rope 102 on display 536. The operator can adjust the load applied to the wire rope 102 by turning an adjustment knob of the first pressure relief valve 512 of the manifold 510.

If the inspection and cleaning devices 112 and 114 are used, then the wire rope 102 should be installed in each of them prior to wrapping the wire rope 102 around the capstans 104. The two pivoting halves 712 and 714 of the inspection device 112 can be pivoted open to expose the inner bore 720 in which the rope can be installed. The two halves 712 and 714 can then be closed and secured using the latch 726. Similarly, the wire rope 102 can be installed in the cleaning device 114 by opening door 804 to expose the bore 806 and pads 808. A latch 822 (FIG. 2) can be provided to secure the door 804 with the main body 802 in a closed position once the wire rope 102 is received in the bore 102. The inspection device 112 inducts magnetic flux into the paramagnetic stainless steel of the wire rope 102 to measure and record any defects in the wire rope 102. The pads 808 of the cleaning device 114 can clean the wire rope 102 and provide lubrication via the oil reservoir 810 if required. The wire rope 102 can also be cleaned by providing fresh water in the rotating tub 106 which can be drained from the rotating tub via a drain plug (not shown). Compressed air from compressor 818 can be fed to the cleaning device 114 via inlet 814 to dry the wire rope 102. Alternatively, a dryer separate from the cleaning device can be provided for receiving the compressed air.

Once inspection of the hoist and wire rope 102 are complete, the rocker switch 522 is moved to up to retract the wire rope 102 back onto the hoist. When the operator reels the wire rope 102 back onto the hoist, the wire rope 102 pulls against the capstans 104. In the retracting mode, the capstans 104 and tub 106 rotate in a clockwise and a counterclockwise direction, respectively, with respect to the front of the system 100. The pull develops torque on the motor 508 which then acts as a pump to create pressure for maintaining a steady load on the wire rope 102 and constant tension through capstans 104. The pressure can be adjusted by turning an adjustment knob of the second pressure relief valve 514.

While a particular embodiment has been chosen to illustrate the invention, it will be understood by those skilled in the art that various changes and modifications can be made therein without departing from the scope of the invention as defined in the appended claims. For example, the drive member 108 can be manual, that is the capstans 104 can be rotated manually instead by a hydraulic or electric drive. For manual operation, the capstans 104 are rotated manually in the same direction, i.e. counterclockwise, as described above to apply the load to the wire rope 102 in the extend mode. In the retract mode, the load can be developed using a band brake that is coupled to the lower capstan 202. The retracting load can be adjusted by a threaded rod and a locking nut that apply tension to the brake. When the hoist is extending the wire rope 102, the brake is unlocked, and when retracting the wire rope 102, the brake is locked. Also, the control 530 can be eliminated.

What is claimed is:

1. A ground support system for wire rope of a hoist, comprising:

a support;

at least two tension capstans aligned on said support, each of said tension capstans being rotatable, and each of said tension capstans having at least one annular groove engageable with the wire rope;

an inspection device mounted to said support to inspect the wire rope;

a take-up member rotatably mounted on said support having an inner receiving area for receiving the wire rope; and a drive member coupled to one of said tension capstans and to said take-up member, said drive member rotating said one of said dual capstans and said take-up member and applying a load to the wire rope.

2. A ground support system according to claim 1, wherein said drive member is a hydrostatic transmission including a hydraulic motor coupled to said one of said tension capstans and said take-up member.

3. A ground support system according to claim 2, wherein said hydrostatic transmission includes an adjustable pressure relief valve for limiting pressure in the hydraulic motor.

4. A ground support system according to claim 1, wherein said drive member being coupled to a shaft of said one of said tension capstans; and said tension capstans being coupled by a drive chain.

5. A ground support system according to claim 4, wherein at least one timing belt is coupled to said drive member;

at least one drive belt is coupled to said take-up member; and said timing belt and said drive belt being coupled by a drive, thereby connecting said tension capstans and said take-up member.

6. A ground support system according to claim 1, wherein a power source is connected to said driver member.

7. A ground support system according to claim 1, wherein said annular groove has an inner diameter that is less than an outer diameter of the wire rope.

8. A ground support system according to claim 1, wherein each of said tension capstans includes a plurality of annular grooves.

9. A ground support system according to claim 1, wherein each of said tension capstans is formed of a polymer material.

10. A ground support system according to claim 1, wherein each of said tension capstans includes a pressure roller for applying pressure to the wire rope when received in said annular groove of said tension capstans.

11. A ground support system according to claim 1, further comprising said drive member rotates said one of said tension capstans and said take-up member at substantially the same velocity.

12. A ground support system according to claim 1, wherein said inspection device includes first and second pairs of magnets.

13. A ground support system according to claim 1, further comprising a cleaning device disposed on said support, said cleaning device including a pad for cleaning, drying, or lubricating the wire rope.

14. A ground support system according to claim 1, wherein a compressor is connected to said cleaning device providing compressed air to said cleaning device to dry the wire rope.

15. A ground support system according to claim 1, wherein said storage tub including a spooler received therein, the wire rope winding around the spooler as the storage tub rotates.

16. A ground support system according to claim 1, wherein said support is disposed on a portable frame.

17. A ground support system according to claim 1, wherein said storage tub is coupled to a slip clutch assembly for adjusting the tangential velocity of said storage tub.

18. A ground support system for a wire rope of a hoist, comprising:

a support;

means for inspecting mounted to said support for inspecting the wire rope for defects;

means for maintaining tension on the wire rope as it reels on and off the hoist, said means for maintaining tension being disposed on said support;

take-up means disposed on said support for storing the wire rope; and means for applying tension to the wire rope coupled to said means for maintaining tension on the wire rope and said take-up means that rotates said means for maintaining tension on the wire rope and rotates said take-up means.

19. A ground support system according to claim 18, wherein said means for maintaining tension on the wire rope includes at least two aligned capstans, and each of said capstans having at least one annular groove for receiving the wire rope.

20. A ground support system according to claim 19, wherein said means for maintaining tension on the wire rope includes means for applying pressure to the wire rope when received in said annular groove.

21. A ground support system according to claim 19, wherein said take-up means includes a rotatable tub, said tub includes a spooler for winding the wire rope thereon.

22. A ground support system according to claim 18, wherein said means for applying tension to the wire rope includes a hydraulic motor and a hydraulic pump, said hydraulic motor being coupled said means for maintaining tension on the wire rope.

23. A ground support system according to claim 18, further comprising means for applying tension to the wire rope rotates said means for maintaining tension and said take-up means at substantially the same tangential velocity.

24. A ground support system according to claim 18, wherein said means for inspecting including first and second magnets creating magnetic flux and sensors for sensing variations in the magnetic flux.

25. A ground support system according to claim 18, further comprising means for cleaning, drying, or lubricating the wire rope, said means for cleaning being disposed on the support.

26. A ground support system according to claim 18, further comprising means for adjusting the amount of tension applied to the wire rope, said adjusting means being in communication with said means for applying tension to the wire rope.

27. A ground support system according to claim 18, further comprising means for measuring the actual tension applied to the wire rope, said means for measuring being coupled to said means for applying tension to the wire rope.

28. A method of maintaining a wire rope of a hoist, comprising the steps of:

reeling the wire rope off of or onto the hoist;

wrapping the wire rope around at least two tension capstans;

storing the wire rope in a take-up member;

rotating the tension capstans and the take-up member;

pulling the wire rope that is wrapped around the tension capstans, thereby maintaining a constant tension on the wire rope as the wire rope is reeled off or reeled onto the hoist; and inspecting the wire rope for defects as the wire rope reels off of the hoist.

29. A method of maintaining a wire rope according to claim 28, further comprising the step of:

rotating the tension capstans and the take-up member at substantially the same tangential velocity.

30. A method of maintaining a wire rope according to claim 28, further comprising the step of:

adjusting the amount of pulling force created by the step of pulling the wire rope.

31. A method of maintaining a wire rope according to claim 28, wherein the step of wrapping the wire rope includes wrapping the wire rope three times around the tension capstans.

32. A method of maintaining a wire rope according to claim 28, further comprising the step of:

cleaning the wire rope.

33. A method of maintaining a wire rope according to claim 28, further comprising the step of:

drying the wire rope.

34. A method of maintaining a wire rope according to claim 28, further comprising the step of:

lubricating the wire rope.

35. A method of maintaining a wire rope according to claim 28, further comprising the step of:

measuring the actual tension on the wire rope after the step of pulling the wire rope.

36. A method of maintaining a wire rope according to claim 35, further comprising the step of:

displaying the actual tension on the wire rope after the step of measuring the actual tension.

37. A method of maintaining a wire rope of a hoist, comprising the steps of:

reeling the wire rope off of or onto the hoist;

wrapping the wire rope around at least two tension capstans;

storing the wire rope in a take-up member;

rotating the tension capstans and the take-up member;

pulling the wire rope that is wrapped around the tension capstans, thereby maintaining a constant tension on the wire rope as the wire rope is reeled off or reeled onto the hoist; and lubricating the wire rope.

38. A method of maintaining a wire rope of a hoist, comprising the steps of:

reeling the wire rope off of or onto the hoist;

wrapping the wire rope around at least two tension capstans;

storing the wire rope in a take-up member;

rotating the tension capstans and the take-up member;

pulling the wire rope that is wrapped around the tension capstans, thereby maintaining a constant tension on the wire rope as the wire rope is reeled off or reeled onto the hoist; and measuring the actual tension on the wire rope after the step of pulling the wire rope.

39. A method of maintaining a wire rope according to claim 38, further comprising the step of:

displaying the actual tension on the wire rope after the step of measuring the actual tension.

* * * * *